US005184751A

United States Patent [19]

Middleton

[11] Patent Number: 5,184,751

[45] Date of Patent: Feb. 9, 1993

[54] DRUM PUMP ADAPTER

[75] Inventor: Dennis G. Middleton, Tyrone, Pa.

[73] Assignee: New Pig Corporation, Tipton, Pa.

[21] Appl. No.: 905,775

[22] Filed: Jun. 29, 1992

[51] Int. Cl.[5] ..... B65D 25/40

[52] U.S. Cl. ..... 220/694; 220/601; 220/571

[58] Field of Search ..... 220/601, 694, 571, 729, 220/745, 746

[56] References Cited

U.S. PATENT DOCUMENTS

| | | | |
|---|---|---|---|
| 1,521,668 | 1/1925 | Bond | 220/694 |
| 3,140,756 | 7/1964 | Dinkelkamp | 184/1.5 |
| 3,196,982 | 7/1965 | Dinkelkamp | 184/1.5 |
| 3,743,144 | 7/1973 | Marh et al. | 220/694 |
| 4,005,796 | 2/1977 | Hirai et al. | 220/694 |
| 4,292,846 | 10/1981 | Barnett | 220/694 |
| 4,936,484 | 6/1990 | Juang | 220/694 |

*Primary Examiner*—Joseph Man-Fu Moy

*Attorney, Agent, or Firm*—Webb, Burden, Ziesenheim & Webb

[57] ABSTRACT

A drum pump adapter which provides for the return of spilled fluid to the drum interior. The drum pump adapter includes a hollow body having a substantially cylindrical interior with an inlet and an outlet opening. The lower portion of the body is provided with a threaded exterior adjacent the inlet opening. An upper portion of the body is provided with a threaded interior adjacent the outlet opening with an inner diameter substantially equal to the lower portion's outer diameter. At least one fluid return hole is positioned between the upper portion's threaded interior and the lower portion's threaded exterior and extends through the body into the body's interior.

20 Claims, 5 Drawing Sheets

DRUM PUMP ADAPTER

BACKGROUND OF THE INVENTION

This invention relates to a drum pump adapter, more specifically to a drum pump adapter which provides for the return of fluid to the drum interior.

The removal of liquids contained within a drum such as, for example, a 55 gallon drum, has proven to be somewhat burdensome and messy. The process can be dangerous when dealing with hazardous materials. Leaky pumps, defective seals and human error all contribute to the spilling of container liquid onto the top of the drum.

The rim provided around the top surface of the drum serves to maintain minimal spills within the confines of the drum surface. However, the rim cannot contain larger spills which will flow over the drum rim.

The placing of absorbing material on the drum's top surface has been utilized to absorb leaks on the top surface of the drum. However, this solution, again, does not work for large spills. Furthermore, this solution does not reclaim any of the spilled material.

It is the object of the present invention to overcome these and other drawbacks of the prior art.

SUMMARY OF THE INVENTION

The aspects of the present invention are achieved by providing a drum pump adapter which couples a pump to a drum and allows for spilled fluid on the top of the drum to return to the drum interior. The drum pump adapter includes a hollow body with a substantially cylindrical interior having an inlet opening and an outlet opening. The lower portion of the body includes a threaded exterior adjacent the inlet opening with an outer diameter which is substantially equal to the diameter of the drum bung. The upper portion of the body has a threaded interior adjacent the outlet opening with an inner diameter substantially equal to both the lower portion's outer diameter and the drum bung diameter. At least one fluid return hole is positioned between the upper portion's threaded interior and the lower portion's threaded exterior, with each fluid return hole extending through the body and into the body's interior.

When positioned in use, the drum pump adapter is threaded into the drum bung such that each fluid return hole is positioned below the drum rim. This arrangement allows for the return of container liquid into the drum interior through the fluid return hole(s) provided in the body.

The drum pump adapter may also be utilized with a drum funnel. The drum funnel includes a base for directing fluids toward a reservoir which is attached to the base at a lowermost portion of the base. A plurality of legs are attached to the bottom surface of the base to support the base on the drum's top surface such that the base is slanted toward the reservoir. A rim is attached to the peripheral edge of the base, and an access opening which can align with the drum bung is provided in the reservoir. In use, the drum funnel is positioned on the drum's top surface with the access opening aligned with the drum bung. The drum pump adapter threadedly engages with the drum bung such that each fluid return hole is positioned below the top surface of the funnel base within the space defined by the drum funnel reservoir. Any container fluid spilled on the funnel will be directed by the base to the reservoir. Any container fluid collected in the reservoir will be returned to the drum interior through the fluid return hole(s) provided in the body.

A gasket or sealing ring may be used with the fluid return drum adapter to provide a better seal with the drum. Further, a filter may be provided to surround each fluid return hole, such that the container fluid which is returned to the drum is filtered of contaminants before being returned to the drum interior.

BRIEF DESCRIPTION OF THE DRAWINGS

Other objects and advantages of the present invention will become apparent from the following detailed description taken in connection with the accompanying drawings, in which.

BRIEF DESCRIPTION OF THE PREFERRED EMBODIMENTS

Figure 1:
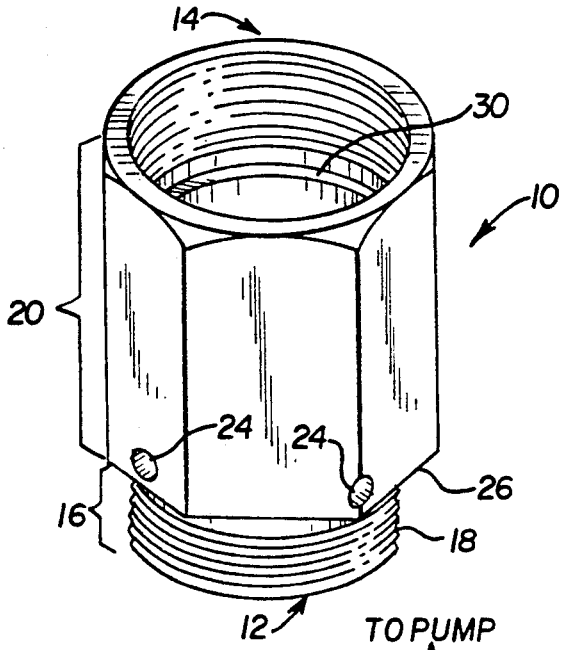
FIG. 1 shows a drum pump adapter.

As shown in FIG. 1, the drum pump adapter of the present invention includes a hollow body 10 which has a substantially cylindrical interior with an inlet opening 12 and an outlet opening 14 positioned at opposite ends thereof. A lower portion 16 of the body 10 is provided with a threaded exterior 18. An upper portion 20 of the body 10 is provided with a threaded interior 22 positioned adjacent the outlet opening 14.

Preferably, the lower portion's threaded exterior 18 is substantially the same diameter as the drum bung and the upper portion's threaded interior.

Fluid return holes 24 extend from the exterior to the interior of the body 10. The fluid return holes 24 are provided at the lower end of upper portion 20 and closely adjacent the upper end of lower portion 16 of the body 10. The fluid return holes 24 may be provided in pairs on diametrically opposed sides of the body 10. The fluid return holes 24 may either be aligned to be orthogonal to the longitudinal axis of the body 10, or positioned to slope toward the lower portion 16 from the exterior to the interior of the body 10. The orthogonal positioning of the fluid return holes 24 allows for machining of diametrically opposed fluid return holes in a single step. The slanted or sloped positioning of the fluid return holes 24 will facilitate the drainage of container liquid back into the drum interior.

Figure 2:
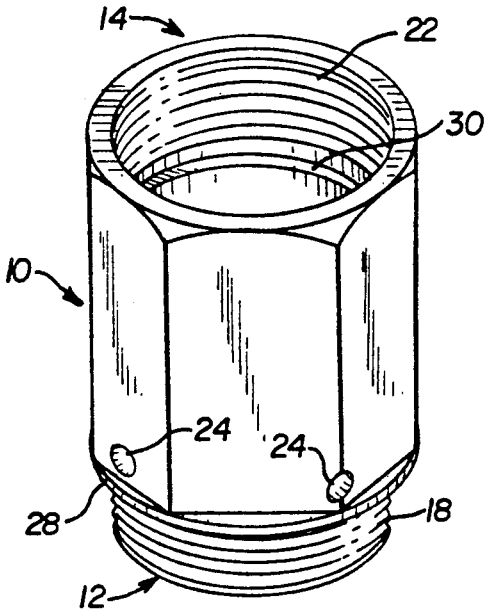
FIG. 2 shows the drum pump adapter shown in FIG. 1, including a sealing ring.

The fluid return drum adapter is provided with a sealing seat 26 positioned between the fluid return holes 24 and the threaded exterior 18 of the lower portion 16. A gasket or sealing ring 28 (see FIG. 2) may be positioned adjacent the sealing seat 26 to provide a better seal between the drum pump adapter and the drum.

A shoulder 30 is positioned in the interior of the hollow body 10 between the threaded interior 22 of the upper portion 20 and the interior of the lower portion 16. The shoulder 30 may act as a stop for threaded couplers connected with the threaded interior 22 of the upper portion 20.

Figure 3:
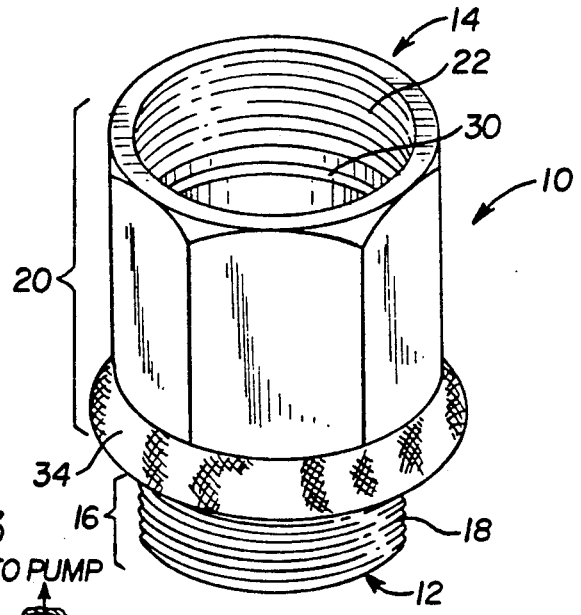
FIG. 3 shows the drum pump adapter of FIG. 1, including a filter.

As shown in FIG. 3, a donut-shaped filter 34 may be provided to surround the fluid return holes 24. The filter 34 will remove contaminants from the liquid being returned to the drum interior.

Figure 4:
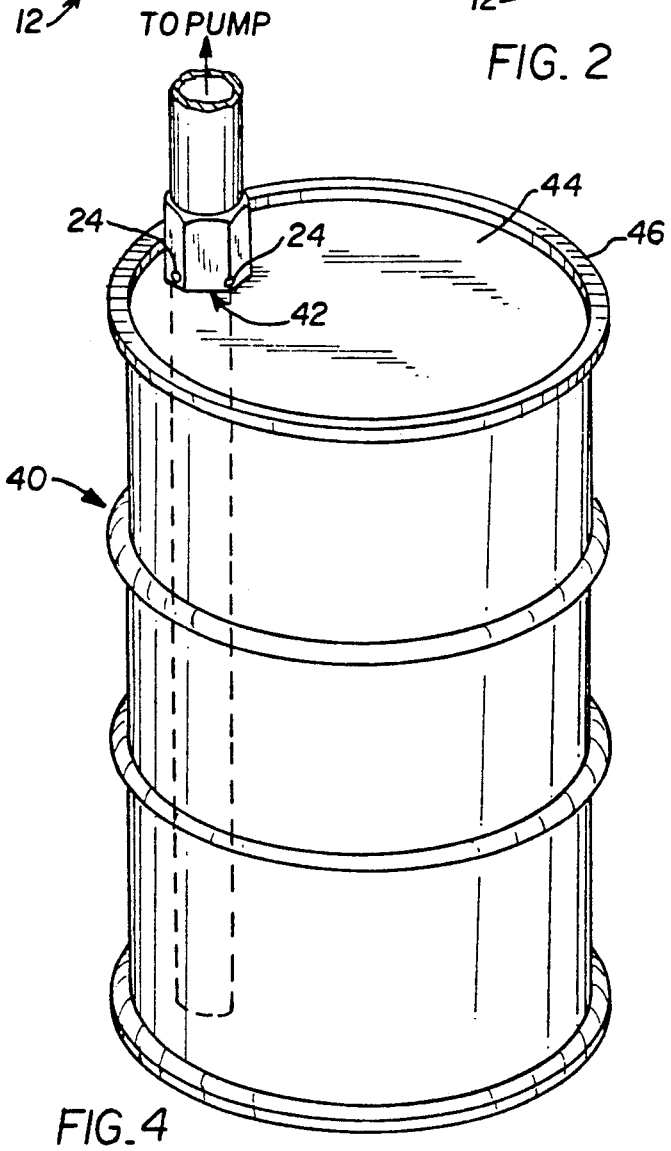
FIG. 4 shows the drum pump adapter of FIG. 1 installed on a drum.

In operation, as seen in FIG. 4, the drum pump adapter is positioned on, for example, a 55 gallon drum 40. The drum 40 contains a drum bung 42 positioned in a top surface 44 of the drum 40. A rim 46 is provided around the top surface 44. The threaded exterior 18 of the lower portion 16 threadedly engages with the drum bung 42 to couple the drum 40 and the drum pump adapter. The drum pump adapter is positioned on the drum 40 such that the fluid return holes 24 are below the upper edge of the rim 46. With this arrangement, only a small amount of spilled liquid will collect on the top surface 44 before reaching the level of the fluid return holes 24 and thus returning to the drum interior 40 through the fluid return holes 24. This arrangement prevents a significant amount of liquid from being collected on the top surface 44 and thereby prevents overflow of the liquid from the top surface 44 over the rim 46.

Figure 5:
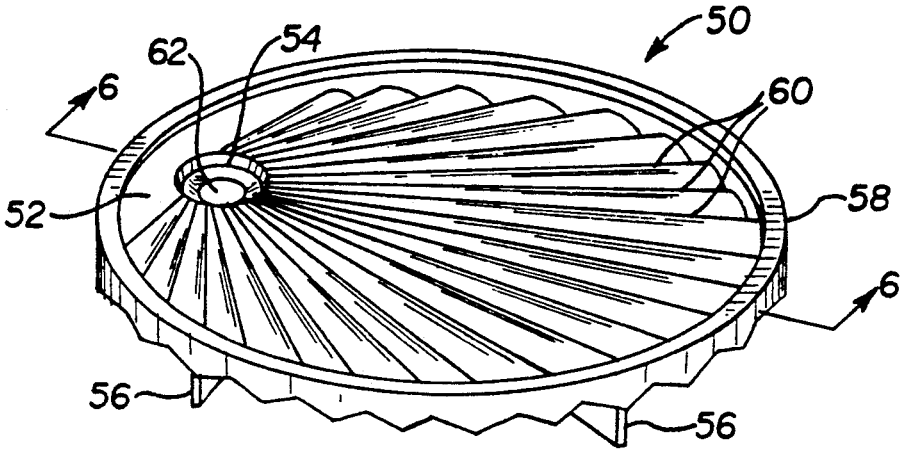
FIG. 5 shows a perspective view of a drum funnel.
Figure 6:
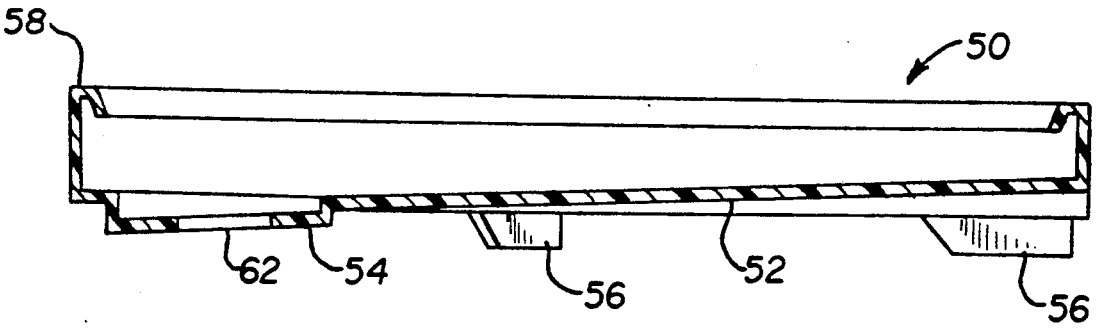
FIG. 6 shows a cross section of the drum funnel shown in FIG. 5 taken along line 6—6.

The drum pump adapter of the present invention can also be utilized with a drum funnel 50 as shown in FIG. 5. The drum funnel 50 includes a tilted or slanted base 52 and a reservoir 54 attached to the base 52 at a lowermost part of the base 52. A plurality of legs 56 are attached to the bottom side of the base 52 and are positioned to support the base 52 on the top surface 44 of the drum 40 such that the base 52 is slanted toward the reservoir 54. A rim 58 is attached to the peripheral portions of the base 52. The rim portion 58 is shaped as a hook in cross section (see FIG. 6) to allow for easy handling.

The base 52 is provided with a plurality of channels 60 extending toward the reservoir 54 which serve to collect and direct fluid toward the reservoir 54.

Figure 7:
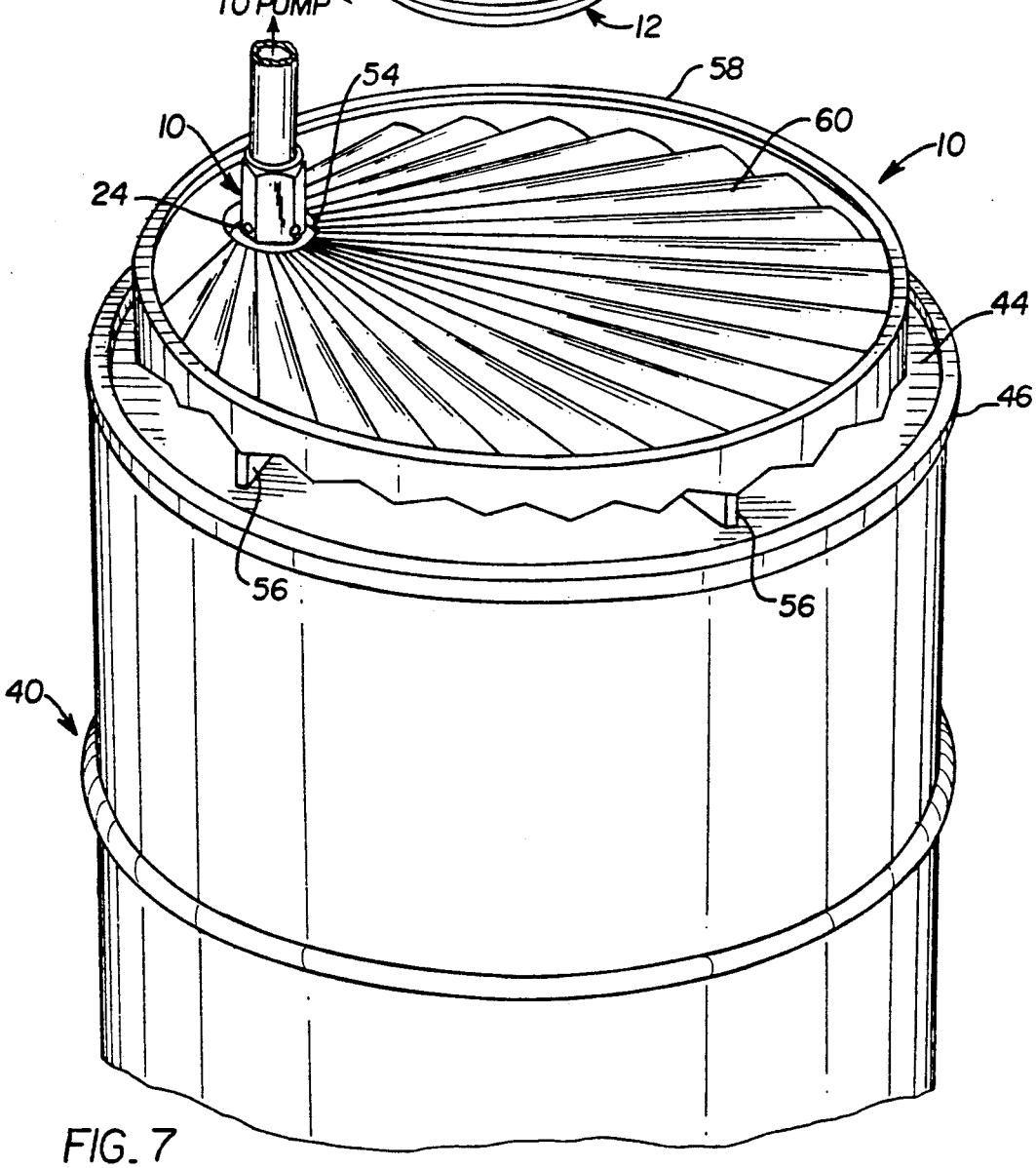
FIG. 7 shows the drum pump adapter of FIG. 1 installed with the drum funnel of FIG. 5 on a drum.

An access opening 62 is provided in the center of the reservoir 54. The access opening 62 aligns with the drum bung 42 of drum 40 to allow for communication with the drum interior. In operation, the lower portion 16 of the drum pump adapter extends through the access opening 62 of the drum funnel 50 and threadedly engages the drum bung 42 of the drum 40. The drum pump adapter is positioned within the reservoir 54 of the horizontal drum funnel 50 such that the return holes 24 are below the top surface of base 52 (see FIG. 7). Excess fluid spilling onto the base 52 of the drum funnel 50 will be directed by the channels 60 to the reservoir 54. Fluid collected in the reservoir 54 will flow through the fluid return holes 24 into the drum interior. This arrangement minimizes the amount of liquid resting in the top surface 44 of the drum 40 before being returned to the drum interior through the fluid return holes 24. With this arrangement, fluid may be directed to the drum interior without having to discontinue or disconnect the pumping mechanism.

Figure 8:
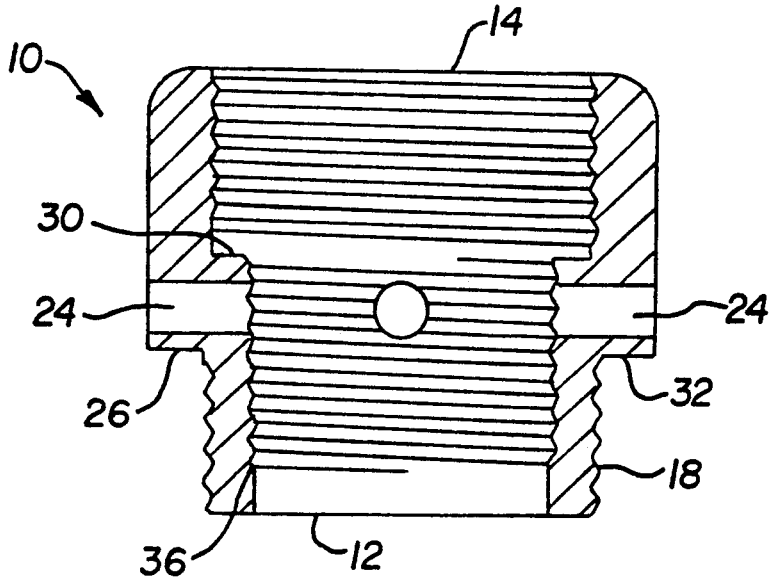
FIG. 8 shows a cross section of a modified drum pump adapter of FIG. 1.

FIG. 8 shows a cross section of a modified drum pump adapter. The drum pump adapter shown in FIG. 8 is similar to the drum pump adapter shown in FIG. 1 and includes a hollow body 10, an inlet opening 12, an outlet opening 14, a threaded exterior 18 in the lower portion, a threaded interior 22 in the upper portion, fluid return holes 24 extending through the hollow body 10, an exterior sealing seat 26 and an interior shoulder 30. The drum pump adapter shown in FIG. 8 is made to thread or screw into the large bung opening of industrial drums and operates in the same manner as the drum pump adapter described in FIG. 1. The only distinction is that the drum pump adapter of FIG. 8 includes a second interior thread 32 in the lower portion of the drum pump adapter below the shoulder 30. A stop 36 may also be provided in the bottom of the second interior thread 32.

Figure 9:
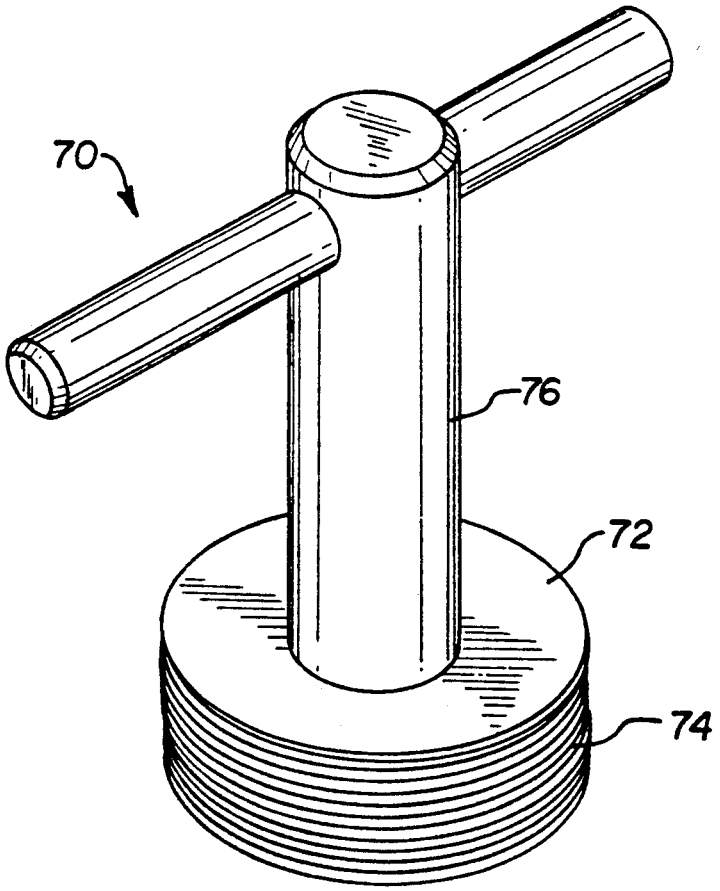
FIG. 9 shows an adapter plug for use with the drum pump adapter of FIG. 8.

FIG. 9 shows an adapter plug 70 which may be utilized with the drum pump adapter of FIG. 8. The adapter plug includes a cylindrical base 72 with a threaded exterior 74 designed to match the threaded interior 22 of the drum pump adapter. A T-shaped handle 76 allows for easy installation and removal of the adapter plug 70 on a drum pump adapter. The adapter plug 70 allows for closure of a drum upon which a drum pump adapter has been installed, thereby providing a closed-head system of storing waste materials. Preferably, the base 72 and the threaded exterior 74 may be sized to match the second interior thread 32 to allow for closure of the drum pump adapter below the fluid return holes 24 to provide a completely sealed system.

Figure 10:
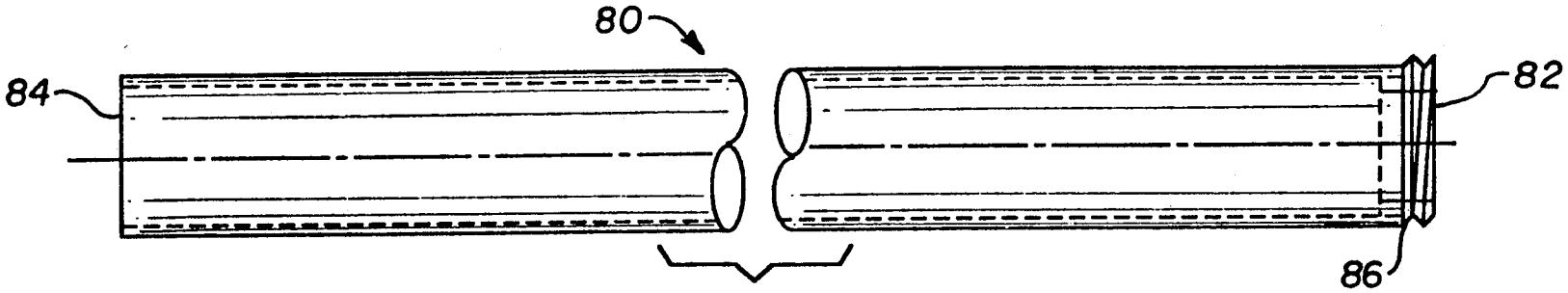
FIG. 10 shows a bottom fill tube for use with the drum pump adapter of FIG. 8.

FIG. 10 shows a bottom fill pipe 80 which may be utilized with the drum pump adapter of FIG. 8. The bottom fill pipe 80 has a solid wall construction with open ends 82 and 84, respectively. A threaded top 86 is provided adjacent open end 82 and threads into the second interior thread 32 of the drum pump adapter. When attached to the drum pump adapter, the bottom fill pipe 80 will extend into the drum to provide access to a lower level within the drum. The bottom fill pipe 80 may be made of any appropriate length.

Figure 11:
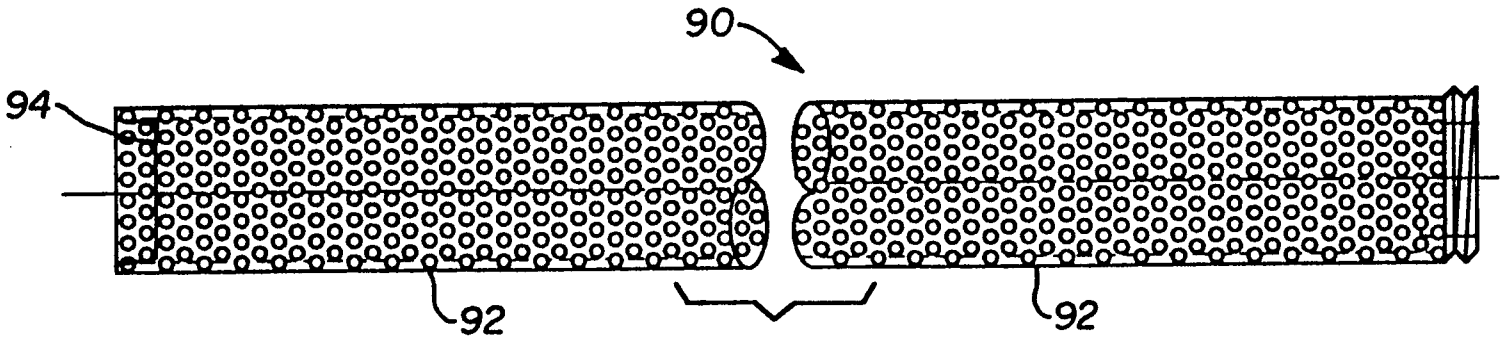
FIG. 11 shows an extended flame arrestor for use with the drum pump adapter of FIG. 8.

FIG. 11 shows an extended flame arrestor 90 which may be utilized with the drum pump adapter of FIG. 8. The extended flame arrestor 90 includes a perforated tube 92 with a closure cap 94 provided at one end. The other end of the tube 92 is open and is provided with a threaded top 96 adapted to thread into the second interior thread 32 of the drum pump adapter. When utilized with the drum pump adapter, the extended flame arrestor 90 will block out sparks which could cause an explosion if working with volatile fluids.

Having described the preferred embodiments of the present invention, it will be obvious to those skilled in the art that various modifications can be made to the subject invention without departing from the spirit and scope thereof. Accordingly, the scope of the present invention is intended to be defined by the attached claims.

I claim:

1. A drum pump adapter comprising:

a hollow body having a substantially cylindrical interior with an inlet opening and an outlet opening, a lower portion of said body having a threaded exterior adjacent said inlet opening, an upper portion of said body having a threaded interior adjacent said outlet opening with an inner diameter substantially equal to said lower portion's outer diameter; and at least one fluid return hole positioned at a lower end of said upper portion, wherein each said fluid return hole extends through said body into said body interior.

2. The adapter of claim 1 wherein each said fluid return hole is positioned closely adjacent said threaded exterior of said lower portion.

3. The adapter of claim 1 further including a sealing seat between said at least one fluid return hole and said threaded exterior of said lower portion.

4. The adapter of claim 3 further including a sealing ring positioned adjacent said sealing seat.

5. The adapter of claim 1 wherein the exterior surface of said upper portion has a polygon shape in cross section.

6. The adapter of claim 1 further including a second interior thread provided within said lower portion of said hollow body.

7. The adapter of claim 1 wherein a plurality of said fluid return holes are provided with each said fluid return hole being positioned diametrically opposite to another of said fluid return holes.

8. The adapter of claim 7 wherein said fluid return holes have a longitudinal axis substantially orthogonal to the longitudinal axis of said cylindrical hollow body.

9. The adapter of claim 1 wherein each said fluid return hole is sloped toward said lower portion from the exterior to the interior of said hollow body.

10. The adapter of claim 1 wherein the outer diameter of said threaded exterior of said lower portion is substantially equal to the drum bung diameter.

11. A combination of a drum pump adapter and a drum funnel comprising:

said drum pump adapter including a hollow body having a substantially cylindrical interior with an inlet opening and an outlet opening, a lower portion of said body having a threaded exterior adjacent said inlet opening, an upper portion of said body having a threaded interior adjacent said outlet opening with an inner diameter substantially equal to said lower portion's outer diameter, at least one fluid return hole positioned at a lower end of said upper portion and substantially adjacent said threaded exterior of said lower portion, wherein each said fluid return hole extends through said body into said body interior; and said drum funnel including a base for directing fluid toward a reservoir which is attached to said base at a lowermost portion of said base, a plurality of legs attached to the bottom side of said base, an access opening positioned within said reservoir, and a rim attached to the peripheral edge of said base;

wherein said access opening aligns with the bung of a drum to provide for communication with the drum, and said adapter extends through said access opening to engage with the bung of the drum.

12. The combination of claim 11 wherein said fluid return holes are positioned below a top surface of said base.

13. The combination of claim 11 wherein said base includes a plurality of channels extending from said reservoir.

14. The combination of claim 11 wherein the outer diameter of said threaded exterior of said lower portion is substantially equal to the diameter of the drum bung.

15. A combination drum and drum pump adapter comprising:

a drum which includes a top surface, a drum bung having a specific diameter positioned within said top surface, and a rim attached to the peripheral of the drum top surface;

said fluid return drum adapter including a hollow body having a substantially cylindrical interior with an inlet opening and an outlet opening, a lower portion of said body having a threaded exterior adjacent said inlet opening, an upper portion of said body having a threaded interior adjacent said outlet opening with an inner diameter substantially equal to said lower portion's outer diameter, at least one fluid return hole positioned at a lower end of said upper portion and substantially adjacent said threaded exterior of said lower portion, wherein each said fluid return hole extends through said body into said body interior, wherein said fluid return holes are positionable below the top surface of said drum rim.

16. The combination of claim 15 wherein an outer diameter of said threaded exterior of said lower portion is substantially equal to the diameter of said drum bung.

17. The combination of claim 15 further including a second interior thread provided within said lower portion of said hollow body.

18. The combination of claim 17 further including an adapter plug threadingly engagable with said drum pump adapter to seal said drum and drum pump adapter combination.

19. The combination of claim 17 further including a bottom fill pipe threadingly engagable with said second interior thread.

20. The combination of claim 17 further including an extended flame arrestor threadingly engagable with said second interior thread.

* * * * *